US009943208B2

(12) United States Patent
Andrews

(10) Patent No.: US 9,943,208 B2
(45) Date of Patent: Apr. 17, 2018

(54) METHOD OF MAINTAINING COMMERCIAL WARE-WASHERS

(71) Applicant: JTA Industries, LLC, Stilwell, KS (US)

(72) Inventor: James T. Andrews, Stilwell, KS (US)

(73) Assignee: JTA Industries, LLC, Stilwell, KS (US)

( * ) Notice: Subject to any disclaimer, the term of this patent is extended or adjusted under 35 U.S.C. 154(b) by 447 days.

(21) Appl. No.: 14/526,329

(22) Filed: Oct. 28, 2014

(65) Prior Publication Data

US 2016/0113474 A1 Apr. 28, 2016

(51) Int. Cl.
*A47L 15/00* (2006.01)

(52) U.S. Cl.
CPC ..... *A47L 15/0076* (2013.01); *A47L 15/0063* (2013.01)

(58) Field of Classification Search
CPC ..... A47L 15/0076; A47L 15/42; B23P 6/00; Y10T 29/49718; Y10T 29/49721; Y10T 29/49723; Y10T 29/4973; Y10T 29/49732
See application file for complete search history.

(56) References Cited

U.S. PATENT DOCUMENTS

| | | | | |
|---|---|---|---|---|
| 4,457,140 | A | 7/1984 | Rastelli | |
| 4,893,478 | A | 1/1990 | Kruck et al. | |
| 4,907,419 | A | 3/1990 | Kruck et al. | |
| 5,209,246 | A | 5/1993 | Tromblee et al. | |
| 5,347,827 | A | 9/1994 | Rudick et al. | |
| 6,068,707 | A | 5/2000 | Magliocca | |
| 6,178,625 | B1 * | 1/2001 | Watson | B08B 3/00 206/320 |
| 6,199,565 | B1 | 3/2001 | Bluestone | |
| 6,904,969 | B2 | 6/2005 | Mueller et al. | |
| 7,691,209 | B2 | 4/2010 | Reichold | |
| 8,182,616 | B2 | 5/2012 | Kuecuek et al. | |
| 8,327,862 | B2 | 12/2012 | Haltmayer et al. | |
| 9,103,061 | B2 * | 8/2015 | Jeffery | D06F 33/02 |
| 9,164,867 | B2 * | 10/2015 | Ebrom | G06F 9/54 |
| 9,359,707 | B2 * | 6/2016 | Bas | D06F 39/005 |
| 9,361,637 | B2 * | 6/2016 | Coon | G06Q 30/0601 |
| 2002/0095269 | A1 * | 7/2002 | Natalini | H04L 12/2803 702/188 |
| 2003/0055666 | A1 * | 3/2003 | Roddy | B61L 27/0094 705/305 |

(Continued)

FOREIGN PATENT DOCUMENTS

| | | | | |
|---|---|---|---|---|
| DE | 10242678 A1 * | 4/2004 | ..... | A47L 15/4251 |
| WO | WO 0241279 A2 * | 5/2002 | ..... | H04L 12/2803 |

OTHER PUBLICATIONS

American Dish Service Parts Manual, Effective Apr. 2014, pp. 28.
Hobart LT-1 Dishwasher Manual, F-8314—Lt-1 Dishwasher, pp. 1-4.

*Primary Examiner* — Ryan J Walters
(74) *Attorney, Agent, or Firm* — Harness, Dickey & Pierce, P.L.C.

(57) ABSTRACT

A method of maintaining commercial ware-washers includes sending a first exchange head to a designated location, receiving a second exchange head requiring repair, repairing the second exchange head, and sending the repaired second exchange head to a designated location. Each of the first and second exchange heads are capable of being removed from and installed on a commercial ware-washer without the use of tools.

31 Claims, 4 Drawing Sheets

(56) References Cited

U.S. PATENT DOCUMENTS

2008/0130520 A1* 6/2008 Ebrom ..... G06F 9/54 370/254
2008/0196751 A1 8/2008 Poyner et al.
2009/0006970 A1* 1/2009 Jeffery ..... D06F 33/02 715/733
2009/0056356 A1 3/2009 Kempte
2011/0208567 A9* 8/2011 Roddy ..... B61L 27/0094 705/7.41
2011/0218957 A1* 9/2011 Coon ..... G06Q 30/0601 706/54
2012/0031442 A1* 2/2012 Plum ..... A47L 15/4229 134/109
2013/0104935 A1* 5/2013 Gnadinger ..... A47L 15/0049 134/18
2013/0186437 A1* 7/2013 Tuller ..... A47L 15/4251 134/99.1
2013/0269736 A1* 10/2013 Baldwin ..... A47L 15/0078 134/60
2013/0319481 A1 12/2013 Welch
2014/0082910 A1* 3/2014 Sullivan ..... G06Q 30/06 29/402.01
2014/0083472 A1* 3/2014 Baldwin ..... A47L 15/0084 134/198
2014/0090676 A1 4/2014 Vroom et al.
2015/0043135 A1* 2/2015 Bas ..... D06F 39/005 361/679.01
2015/0296087 A1* 10/2015 Jeffery ..... D06F 33/02 370/352
2016/0028556 A1* 1/2016 Ebrom ..... G06F 9/54 709/223
2016/0078695 A1* 3/2016 McClintic ..... G06Q 10/06 701/29.4
2016/0113474 A1* 4/2016 Andrews ..... A47L 15/0076 29/402.01
2016/0123600 A1* 5/2016 Phillips ..... H04B 10/116 99/337

* cited by examiner

METHOD OF MAINTAINING COMMERCIAL WARE-WASHERS

FIELD

The present disclosure relates to commercial ware-washers, especially to the maintenance and repair of parts used to control the functions of commercial ware-washers. More particularly, the present disclosure relates to a method of maintaining a ware-washer control assembly that includes the parts that require maintenance and repair and is removable from a ware-washer without the use of tools.

BACKGROUND

This section provides background information related to the present disclosure which is not necessarily prior art.

In the 1950s, ware-washing technology involved a machine, with a holding tank, pumping and heating wash water for repeated cycles. The ware-washing machine typically used a building's water supply heated to about 180° F. in a final rinse to sanitize wares, such as dishes, cups, utensils, pots, pans, and the like. A typical ware-washer included a sustainer-heater for the holding tank, dual delivery spray systems, and a booster water heater. These types of ware-washing machines are known as High Temperature (high temp) ware-washers. All of the ware-washer's pumps and heaters were permanently connected to a building's energy supply sources such as electricity, steam, or gas energy. The high temp ware-washers required continuing and intensive service to maintain acceptable operation. Providing timely repair and replacement of the ware-washers was required so that the foodservice facility could continue to operate and serve food. Such repair and replacement required maintaining a fleet of service trucks stocked with repair parts, supplies, chemicals, and also required trained personnel to repair or replace the ware-washer. The ware-washer repair businesses incurred significant costs for the truck fleet, the parts inventory, and to train and maintain reliable repairmen. The restaurant or food-service owner typically incurred repair charges for any repairs required.

Later, a new ware-washing approach developed. This new approach centered around a new type of ware-washer. This new type of ware-washer became to be referred to as a Low Temperature (low temp) Ware-Washer. The low temp ware-washer washed the wares in a batch of water. When the washing cycle finished, the batch of water was dumped to the drain and a fresh batch of water was brought into the ware-washer and used to rinse the wares and complete the cleaning. The batch of water used to rinse the wares was typically used as the wash water, in the next cycle. These low temp ware-washers typically inject chlorine or other chemicals into the batch of water, sanitizing the wares in the final rinse. In addition, there is also a rinse additive added to the batch of water facilitating a sheeting action to reduce water spotting on the wares. Also, detergent is added to the batch of water before starting the washing cycle. The low temp ware-washer typically does not require a boost heater to heat the batch of water to 180° F. because the added sanitizing chemicals provided adequate sanitization using a building's typical hot water supply at temperatures of about 120° F. Compared to high temp ware-washers, low temp ware-washers are lighter, easier to repair, do not require booster heaters, and may be operated using 120 Volt (V) power. As with the high temp ware-washers, the low temp ware-washers are permanently connected to a facility's energy and water supplies and the parts are attached to a ware-washer cabinet with nuts and bolts or other attachments requiring tools.

The low temp ware-washers have proved more reliable, use less energy than the high temp models, and have become very popular in the ware-washer industry. Ware-wash chemical supply companies have developed a system where a low temp ware-washer is provided or leased to a food service facility at low or no-cost in return for the food-service provider's promise and obligation to purchase ware-wash chemicals for use in the low temp ware-washer. The ware-wash chemical supplier typically installs the ware-washer, restocks the chemicals, and maintains and repairs the ware-washer as needed during the term of the agreement. This has become a popular option for food service providers because it reduces capital equipment costs and eliminates equipment maintenance and repair costs for the ware-washer, and saves energy costs compared to high temp ware-washers. The ware-wash chemical suppliers like the arrangement because it provides a predictable revenue stream over an extended time period and allows the cost of the ware-washer and its maintenance and repair to be amortized.

The ware-wash chemical suppliers need to provide or contract with a service provider for a fleet of trucks, stocked with parts driven by trained technicians to maintain and repair the ware-washers placed in a given territory. The cost of labor, the time required to be spent at each placement site, the cost of finding, training, and retaining personnel, and the expense of travel time between each repair site all adds up to a significant expense. In addition, it is important that repair of the ware-washers be provided promptly and essentially for 24 hours per day, seven days per week. If the food service facility cannot wash its wares it cannot stay open for business.

The current general trend in all business is to improve inventory efficiency to maximize cash flow. The ware-washer users experience some negative effects of this trend where the user must wait for parts to be ordered and delivered and may also have to wait for the availability of a service technician. This may lead to multiple trips to a location requiring repair of a ware-washer. Maintenance and repair delays generally may occur for two reasons. First, low inventory levels of repair parts maintained by the companies increase the odds that a part needed will not be immediately available. The other reason for delay is because it is difficult to find, train, and keep qualified field repair technicians. These issues create a barrier to business expansion.

Thus there is a need to provide a method to quickly and reliably maintain ware-washers that does not rely on a chemical supply company maintaining significant repair parts inventories or a need for trained repair technicians in the field.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
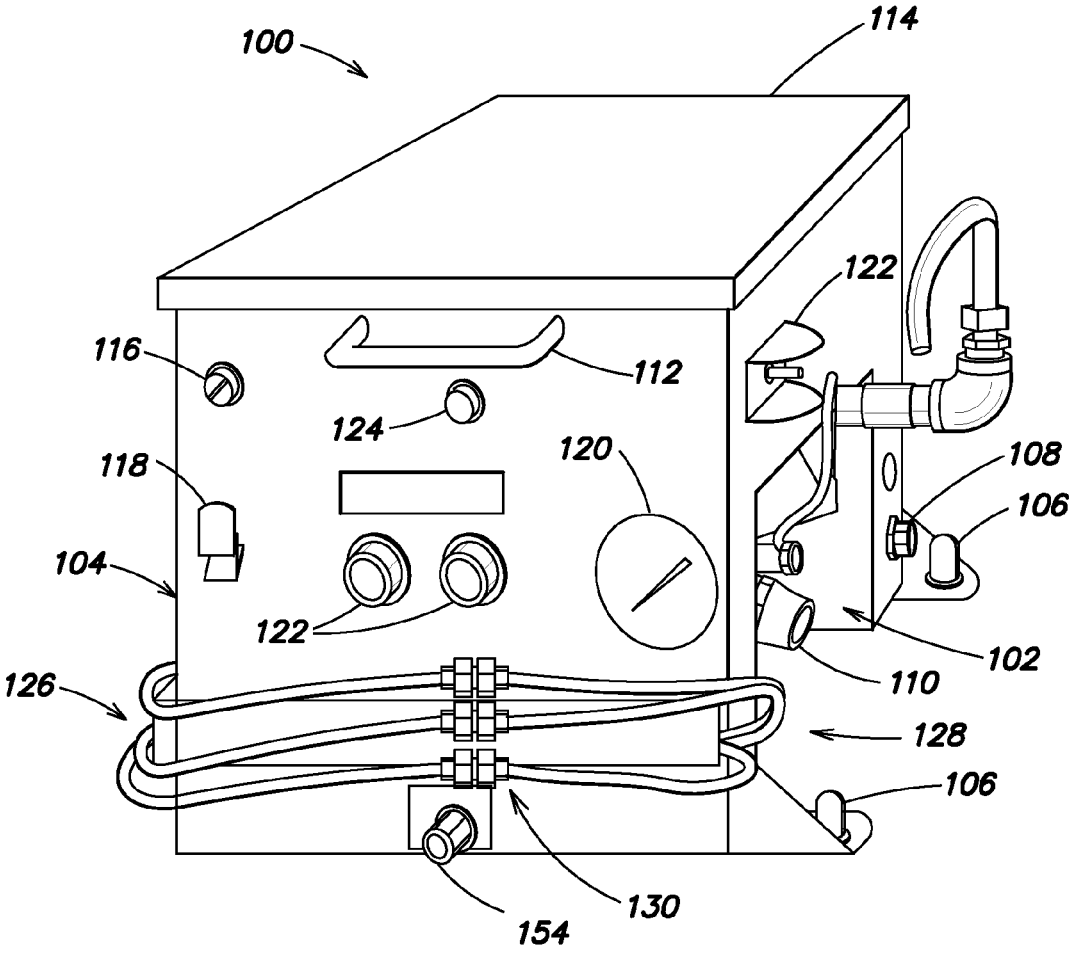
FIG. 1 is a perspective example of an exchange head used in the example methods.

Example embodiments will now be described more fully with reference to the accompanying drawings.

The example methods described in this disclosure may be incorporated for use to both "low temp" and "high temp" ware-washers described above. The example methods allow for quick removal of those ware-washer components requiring predictable maintenance or repair. The example methods disclose using a control assembly (also referred to as an exchange head) containing the ware-washer components requiring predictable maintenance, where the exchange head is removable from a ware-washer without the use of tools and there is no need for understanding the operation and repair of the components. The example methods may allow a ware-washer to be restored to factory specifications in less time than performing simple maintenance operations on a prior art ware-washer. Service technician time at a service location may be reduced using the example methods compared to a typical prior art service call. For example, a routine prior art service call requiring from 40 to 90 minutes for service or preventative maintenance may be reduced to a 5 minute call to exchange a malfunctioning exchange head with a replacement exchange head using the example methods.

An advantage of the example methods is that an exchange head will fit easily into a shipping box or may be carried to an account in a service truck. An exchange may be shipped to an account using a courier or an overnight freight service, and may be installed by a service technician or by an untrained person that is unfamiliar with the equipment. Once removed from the ware-washer, an exchange head in need of maintenance may be taken or shipped to a remote site for repair and refurbishing. The remote refurbishing site may be a chemical supplier's in-house site or the remote site may be a ware-washer manufacturer. The exchange head in need of maintenance may be repackaged in a shipping box that the replacement exchange head arrived in.

The example methods disclosed using an example exchange head provides new methods for the commercial ware-washer industry to maintain ware-washers at a wide variety of locations.

The example methods allow companies using the traditional "high temp" model to change how the installed equipment is serviced. Reducing the amount of time a service technician spends at each service location allows each service technician to provide service to more accounts in a given time period. This potentially may reduce the number of technicians needed or may increase the service area that may be covered by a technician. The fact that no particular operating parts need to be serviced on site and that the each exchange head may be removed and installed without the use of tools significantly lowers the training and knowledge required of the technician.

In addition, swapping a functioning exchange head for a malfunctioning one and carrying or shipping the malfunctioning exchange head to a remote facility for repair and refurbishment may significantly lower the labor costs for maintaining and repairing an installed inventory of ware-washers. Replacement exchange heads may be stored at the ware-washer manufacturer, a chemical supplier's repair facility, or carried with a service technician in their vehicle.

One example includes shipping a replacement exchange head, upon demand, directly from a remote facility to a ware-washer site. An employee at the ware-washer site may be able to remove the malfunctioning exchange head and install the replacement exchange head, without any need for a service technician at the ware-washer site, because each exchange head may be removed and installed without the use of tools and because no problem troubleshooting or part repair is needed. If a ware-washer site employee is used to swap-out the exchange heads, it may be required to have someone at the ware-washer site send the current exchange head's timer settings to the remote facility, before the replacement exchange head is shipped, so that the replacement exchange head will operate as intended. The timer settings may be sent in any acceptable manner such as in written form via a text or email message, by sending a photograph showing the timer settings, or any other acceptable method.

The disclosed methods may also allow companies using the traditional "low temp" business model to have the same benefits described above and in addition may allow a chemical supplier to expand the territory size that may be effectively serviced with the same or fewer service technicians. A typical prior art service territory is about a 200 mile radius from the service technician's base of operations. Because the example methods shorten each service call time the service territory range may be expanded greatly, perhaps even doubling the service territory with the same or fewer technicians, vehicles, and inventory costs.

The example methods also may allow chemical suppliers or ware-washer owners to establish exchange head replacement schedules. This would allow exchange heads to be replaced before there is a complete failure and greatly reduce the number of emergency repairs. Such scheduled exchange head replacement may reduce the total number of service calls required because the component parts most likely to fail will be regularly cleaned, repaired, and refurbished negating many service calls to fix individual randomly failing parts. The replacement schedule may be any suitable schedule acceptable to the parties involved. Some factors influencing a replacement schedule may include the level of ware-washer usage (the more a ware-washer is used the more often a replacement is warranted), the chemicals used (the more caustic the chemicals the more often a replacement is warranted), the location of the ware-washer (a more remote location may warrant more frequent replacement to avoid emergency failures that would be difficult to service), a risk tolerance for ware-washer failure (the less the risk tolerance the more often a replacement is warrant), a confidence factor for predicting a failure rate of the component parts of the exchange head (the less the confidence in a predicted failure rate the more often a replacement is warranted), and an estimated cost of operating the replacement schedule. It is believed that a sufficient replacement schedule may be to replace an exchange head two or three times per year without increasing the overall cost of maintaining a ware-washer compared to prior art ware-washer maintenance. Such replacement schedules may also have the added benefit of improved ware-washer user satisfaction because of a reduction in ware-washer failures.

The example methods also allow a ware-washer user/owner, such as a healthcare facility, a school, a nursing home, a daycare business, or other entity that owns its own ware-washer to manage its maintenance costs. These types of companies include those where it consumption of ware-washing chemicals is not sufficient to be attractive to a chemical supplier to provide the company with a ware-washer and the accompanying maintenance costs. These ware-washer user/owners typically have on-site maintenance staff that should be easily capable of replacing a failing exchange with a replacement exchange head, at least because no tools are used and no diagnostic knowledge and training is required. The failing exchange may then be carried or shipped to a remote maintenance facility for refurbishment. The above described replacement schedules may also be established for a ware-washer user/owner.

The example methods may also allow a chemical supplier or a user/owner to greatly reduce or eliminate many maintenance costs by establishing an exchange head replacement agreement with a third party, such as the ware-washer manufacturer or other exchange head provider.

The example methods allow a ware-washer manufacturer to service an installed ware-washer base in a timely manner and reducing ware-washer failures experienced with prior art ware-washers and service methods. Creating greater ware-washer up-time through the use of the example methods and novel exchange head benefits the ware-washer user, the chemical suppliers, and the ware-washer manufacturer. The ware-washer manufacturer's brand and reliability reputation should be bolstered through the use of the example methods.

The example methods allow for a single central repair and refurbishment location to service national or international inventories or ware-washers. Returned exchange heads may be cleaned, updated, repaired, refurbished, and bench-tested prior to returning to service in the field. The exchange heads may be coded and assigned to a particular company such that only exchange heads assigned to the company will be used for ware-washers owned by the company. Another possibility is for a manufacturer or other exchange head supplier to offer an open, unassigned exchange head replacement.

Returning exchange heads to a central location reduces the need for duplication of repair parts inventory at many regional sites. Particularly for chemical suppliers and large ware-washer repair services, inventory costs, facility square footage needs, service vehicle maintenance costs, and technician training costs may be significantly reduced. The traditional low-temp model of providing full ware-washer service with a lease/chemical purchase agreement becomes more manageable using the example methods from both a cost and service personnel perspective. Even if an exchange head replacement schedule is not used, a malfunctioning exchange head may be replaced within a day using well-known overnight courier services to send a replacement exchange head to the location of the malfunctioning exchange head. For areas with a sufficient installed ware-washer base, replacement exchange heads may be stored locally so that a malfunctioning exchange head may be replaced within a few hours.

Ware-washers in locations far from normal service or sales routes a replacement exchange head may be installed within a day of a malfunction by having personnel at the ware-washer location perform the labor, without need of diagnostic skills or tools. Directions for removing and replacing exchange heads, if needed or desired, may be provided in any acceptable manner. For example, directions could be in the form of printed materials sent with a replacement exchange head, a video available through an internet site, or through labels and stickers attached to the exchange head.

It is noted that a malfunctioning exchange head may be replaced with a fully functioning exchange head in a matter of a few minutes using the example methods compared to a half-hour or more for a prior art ware-washer. The example methods allow for a ware-washer's down time to be greatly reduced, thereby minimizing any negative impact on the operations at the site of the ware-washer.

The example methods may allow for a consistent quality of exchange head performance, allow for a centralized and concentrated pool of qualified service talent, and may allow for standardized testing and certification procedures to be conducted on every repaired and refurbished exchange head.

FIG. 1 shows a ware-washer control assembly 100 (the assembly 100 may also be referred to as an exchange head) capable of being removed from and installed on a commercial ware-washer without the use of tools. A more detailed disclosure of an example exchange head is provided in co-pending patent application entitled Commercial Ware-Washer Exchange Head, filed on the same day as this disclosure and is hereby incorporated by reference in its entirety. The exchange head 100 represents both a first replacement exchange head and a second malfunctioning exchange head in need of repair. The exchange head 100 may include electrical components (not shown but mostly contained within housing 104), an inlet water plumbing assembly shown generally at 102, a drain mechanism (not shown, but contained within housing 104). Each of the electrical control components, inlet water plumbing assembly 102, and the drain mechanism are contained within or attached to a housing 104 (also referred to as an exchange head housing) for shipment and off-site service and distribution. The housing 104 includes at least a first connector 106 for attaching the housing 104 to a ware-washer cabinet (not shown). The ware-washer control assembly 100 further includes a plurality of connectors for connecting the electrical control components and inlet water plumbing assembly 102 to a corresponding supply source (not shown) and for connecting the drain mechanism to a drain plug assembly (not shown). Each of the first connector 106 and the plurality of connectors may be connected and disconnected by a user without tools. The control assembly 100 may include an electrical connector 108 and may be a threaded connector or other suitable connector that is connected and disconnected without tools and a quick-connect coupling 110 for attaching the inlet water plumbing assembly 102 to a water supply (not shown). The assembly 100 may include carrying handles 112 and a lid 114. FIG. 1 also shows connection structure 116, 118 for attaching a portion of the drain mechanism to the housing 104. The housing 104 may further include gauges, switches, and indicator lights such as those shown at 120, 122, and 124.

FIG. 1 is also shown with tubing 126 and 128 connected to each other for shipment to an offsite facility; such a connection prevents chemicals leaking into packaging during shipment. In operation, tubing 126 is connected to a tubing manifold (not shown) for dispersing chemicals from chemical pumps contained within housing 104 and tubing 128 is connected to a plurality of chemical supply sources (e.g. buckets held under the ware-washer). Ensuring that each of the tubes 126 has either a female or a male quick connector and the tubes 128 has the other of the female or male quick connector allows the ends of tubing 126 to be quickly connected to the ends of tubing 128, as shown at 130. Thus, the tubing 128 for connection to the chemical source includes a chemical connector and the tubing 126 for connection to a chemical dispensing location includes a mating connector to the chemical connector such that the chemical and mating connectors may be connected to each other during shipping to prevent leakage of chemicals from the tubing 126, 128.

The exchange head 100 is significantly improved compared to comparable portions of a prior art ware-washer where the electrical and plumbing connections were essentially permanent and required trades skills and significant use of tools to install and remove the connections. In addition, prior art ware-washers had the electrical, inlet water plumbing assembly, and drain mechanism all fixedly attached to disparate parts of the ware-washer; removal and installation of each of these parts also required a use of tools and some specialized knowledge and skill. In contrast, the exchange head 100 incorporates the parts of a ware-washer that require predictable periodic repair and maintenance in a single easily removed and installed package. No tools or specialized knowledge or training are needed to remove and install exchange heads 100.

Figure 2:
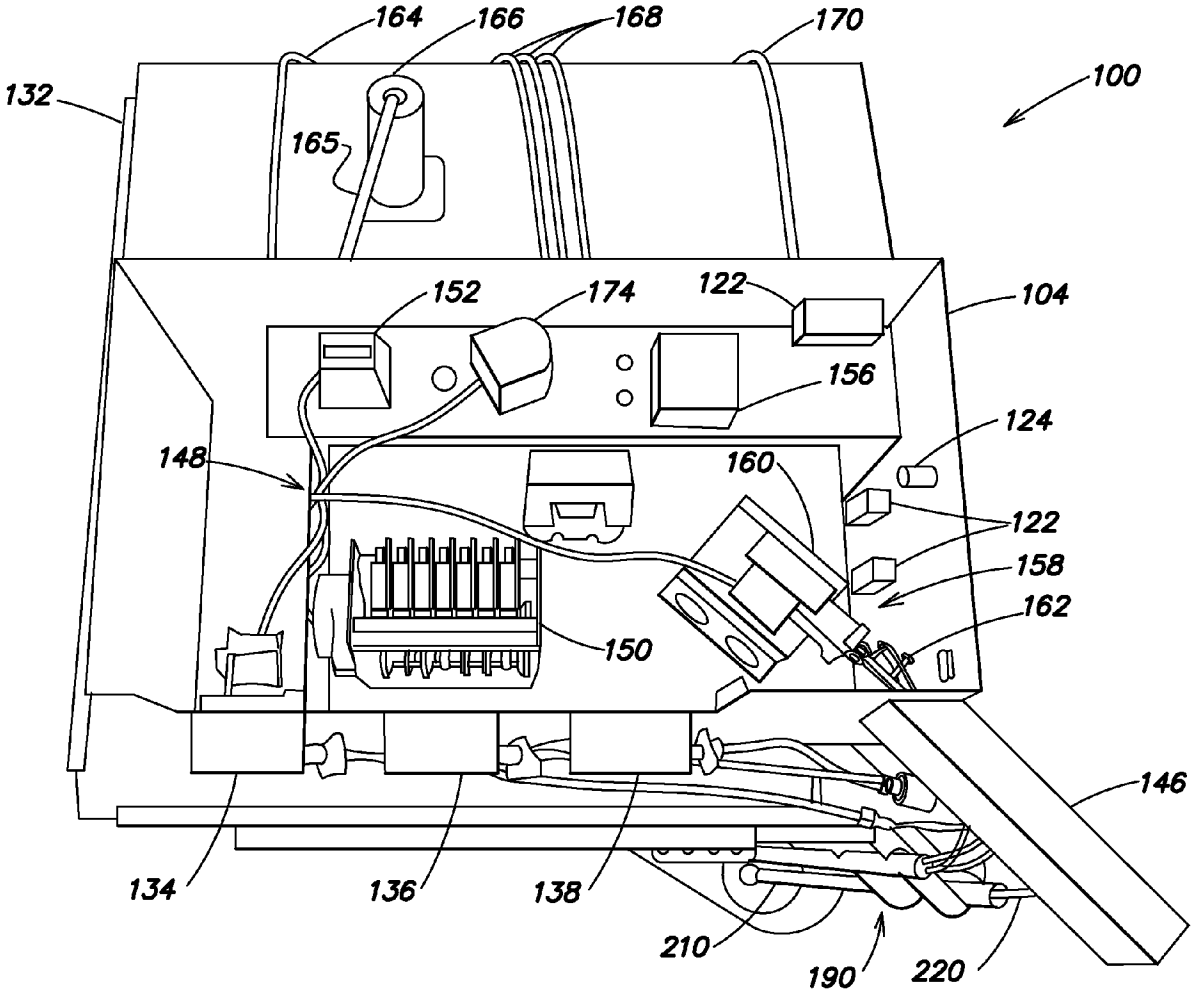
FIG. 2 is an alternate perspective of the exchange head installed on a ware-washer.

FIG. 2, with lid 114 removed, is a top perspective view with the exchange head 100 attached to a ware-washer cabinet 132 and shows some electrical components held within housing 104. The electrical components may include one or more of a wire harness shown generally at 148, a timer 150, an indicator light 124, a user-activated switch 122, a counter 152, a door cut-off switch 154 (shown in FIG. 1), and an auto-start actuator 156. FIG. 2 also shows the drain mechanism, shown generally at 158, and may include a linear solenoid actuator 160. The drain mechanism 158 may be connected to lifter assembly 146 via any appropriate connector such a pull pin 162 or other connector that may be operated without tools. FIG. 2 further shows electrical cable 164 connected to housing 104 (connection at connector 108 not shown in FIG. 2); water supply tube 165 of inlet water plumbing assembly 102 is connected to an air gap fitment 166, chemical supply tubes 168 are connected to tubing 128 via appropriate quick connectors (quick connectors and tubing 128 not shown in FIG. 2), and water supply hose 170 is connected to the housing 104 (connection at connector 110 not shown in FIG. 2. Three chemical pumps 134, 136, and 138 are also shown. In addition, a water supply solenoid valve 174 is shown and may form a part of inlet water plumbing assembly 102.

Drain mechanism 158 via linear solenoid actuator 160 manipulates the drain lifter assembly 146 to raise and lower a drain plug assembly, shown generally at 190, to open and close a drain into a sump assembly as is known. Any suitable drain mechanism that interacts with a drain plug assembly to open and close the drain is acceptable. Prior art ware-washers typically attached a solenoid actuator to a side of the ware-washer cabinet with a drain plug assembly directly attached to the actuator. Placing the drain mechanism 158 within control assembly 100 required the drain lifter assembly 146 to accommodate the linear solenoid actuator's reciprocating motion to be transferred from the top of cabinet 132 around and down the side of cabinet 132, as can be seen in FIG. 2. Drain plug assembly 190 may include a drain plug 210 and an attachment device (not shown) for attaching the drain plug assembly to a linkage assembly (not shown). The linkage assembly may include a length of chain and tensioner (typically plastic tubing surrounding the chain) for connection to the drain plug assembly 190 at a first end and for connection to a link-rod 220 at a second end using a suitable quick connector that may be operated without tools (the first and second end connections and the quick connector are not shown).

Figure 3:
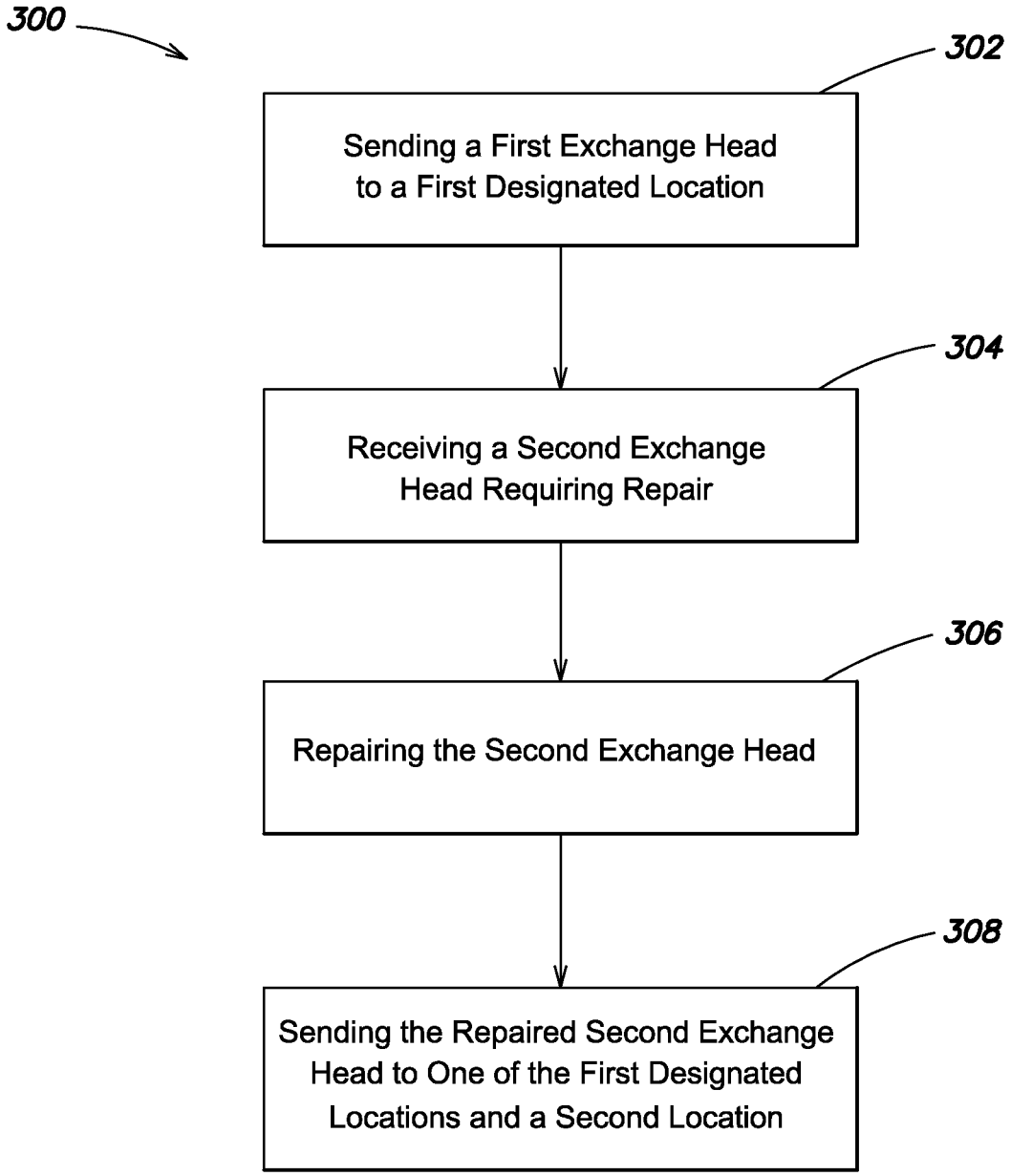
FIG. 3 is a logic flow of an example method.

A method 300 of maintaining commercial ware-washers is shown in FIG. 3. Method 300 includes sending a first exchange head to a first designated location at step 302. As described above the first exchange head may be a fully functioning exchange head 100 that will be a replacement exchange head for a malfunctioning exchange head or a replacement exchange head for swapping out an exchange head due for replacement on a maintenance schedule. The first designated location is any suitable location accommodating the needs of the ware-washer owner and may include a central inventory site, a customer's warehouse, or a ware-washer location site. Sending may include any desired method such as, for example, shipping via a package delivery service, carrying the exchange head on a service vehicle, or transporting the exchange head to the first location via a courier service.

Method 300 continues at step 304 including receiving a second exchange head requiring repair. The received second exchange head may be an exchange head 100 that is malfunctioning or is scheduled for replacement according to a maintenance schedule. The second exchange head may be received at any appropriate location, as described above, and may include a ware-washer manufacturer's repair facility, a ware-washer owner's repair facility or any facility. The received second exchange head may or may not be the exchange head replaced with the first exchange head at the first location. Since each exchange head for each type of ware-washer will be essentially identical and the second exchange heads will not need to be replaced simultaneously, the number of first exchange heads (also referred to as replacement exchange heads) required may be less than the number of installed ware-washers of any given type. The number of replacement exchange heads needed by a ware-washer owner will depend on the number of ware-washers that are in operation and the level of usage of those ware-washers. If an owner only has a single ware-washer, then a single replacement exchange head is needed to avoid unacceptable down-time of the ware-washer. However, as the number of ware-washers in operation increases a ratio of the number of replacement exchange heads required to the number or ware-washers in operation will decrease below 1. If a ware-washer owner carries one or more replacement exchange heads on each of the owner's service vehicles the ratio may be greater than if all of the owner's replacement exchange heads are stored at a central location. Also, some owner's ware-washers may experience harsher use than others, requiring more replacement exchange heads than another owner with an equal number of ware-washers. Many factors will determine an optimal number of replacement exchange heads needed for a given inventory of ware-washers.

Next, step 306 includes repairing the second exchange head. The second exchange head received in step 304 may be a malfunctioning exchange head or it may be an exchange head received pursuant to a maintenance schedule. Any repairs required will depend on the condition of the second exchange head and may include one or more of cleaning, fixing, adjusting, tuning, calibrating, replacing, or any other actions needed to refurbish the second exchange head to a fully functioning exchange head meeting established specifications. Part of repairing the second exchange head may include testing the second exchange head upon receipt to diagnose any operational issues to determine if any component parts need repair or replacement and testing after repair to ensure that the repaired exchange head is operating properly.

Once the second exchange head is repaired, step 308 includes sending the repaired second exchange head to one of the first designated location and a second designated location. Step 308 may also include storing the repaired second exchange head at the repair location. The repaired exchange heads may also be returned to a ware-washer owner to a location of the owner's designation. The first location of step 302 may be the site of a ware-washer failure or it may be a central depot location of a chemical supplier that owns many ware-washers. Likewise, the second location may be a site of another ware-washer failure or a ware-washer site due for scheduled exchange head maintenance.

It is important to note that implementation of the method 300 is made practical and economical because each of the first and second exchange heads are capable of being removed from and installed on a commercial ware-washer without the use of tools. If tools and trained service technicians were required to remove and install an exchange head it would require too much time and there would be no significant reduction in repair and maintenance costs. The exchange head as described above also provides the added benefit of placing the parts of the ware-washer that are known to require periodic maintenance and repair in a single compact housing. The prior art ware-washers had the various parts requiring maintenance and repair distributed at disparate locations on the ware-washer. Removing and replacing several component parts that are located at different parts of the ware-washer quickly becomes complicated and difficult for an untrained person to achieve. Providing a single compact housing allows reliable efficient shipping to and from a remote repair facility and allows for easy, quick, efficient removal and replacement at the ware-washer site.

The method 300 may include a step of selling or leasing at least one commercial ware-washer and the first and second exchange heads to a customer before beginning step 302. The terms of any sale or lease may include a variety of payment and credit options and details regarding liability for storing, handling, and shipping the exchange heads, as well as details about exchange head maintenance schedules and the type and amount of repair and refurbishment to be done on the exchange heads.

The method 300 may further include the steps of receiving a timer setting of a faulty exchange head and duplicating the received timer setting on a first timer of the first exchange head. These steps may be considered details the repairing the second exchange head but the timer setting must be received before the second exchange head is sent to a new location, if the repaired exchange head is designated for a specific ware-washer location. If the repaired exchange head is not designated for a specific ware-washer location it may not be necessary to adjust the first timer settings, as this can be done at a later time before the second exchange head is sent or by a service technician or other person at the ware-washer location. The timer settings may need to be adjusted because a water pressure and temperature available at each ware-washer location may vary significantly. The available water pressure affects how quickly the ware-washer's water supply can be refilled before a new wash cycle can begin. The receiving the timer setting step may include any acceptable way of communicating a ware-washer's current timer setting to the remote repair facility. One example is the repair facility receiving a picture of the timer of the faulty exchange head. The picture may be received by any acceptable way such as email, mobile telephone message, fax, mobile telephone application, or other acceptable ways. Receiving the timer setting may also include receiving a written explanation of the timer setting via email, mobile message, fax, mobile application, or other acceptable ways.

The receiving step 304 may also include receiving a drain plug assembly with the second exchange head. The drain plug assembly may be received within the second exchange head housing as described above. Receiving a drain plug assembly should be understood as also possibly receiving one or more of a drain ball and associated tube, the drain lifter assembly, the link-rod, and linkage assembly described above.

The repairing step 306 may further include setting a second timer of the second exchange head to correspond to a timer setting of a faulty exchange head to be replaced with the second exchange head. The timer settings of the faulty exchange head may be determined as described above. If the second timer of the second exchange head is set to correspond to the faulty exchange head timer then no timer adjustments will be needed during installation of the second exchange head at the ware-washer site.

The repairing step 306 may also include at least one of cleaning the second exchange head, repairing faulty chemical tubes, repairing faulty electrical components, repairing a faulty inlet water plumbing assembly, and repairing a drain mechanism. Repairing the chemical tubes may include a full or partial replacement of one or more tubes. It is known that a single chemical tube for may be formed of multiple tube sections that provide reliable yet economical tubing. For example, the tube portion that is squeezed by the peristaltic pumps may have tubing that is more robust and less compliant than the tube sections that connect to a chemical source or that transport the chemicals pumped from the chemical pumps in the exchange head. The repairing step 306 may further include repairing a drain plug assembly. If a drain plug assembly is repaired then a repaired or refurbished drain plug assembly will need to be sent in the second exchange head. As described above the exchange heads may have dedicated structure for holding some or all of the drain plug assembly or there may simply be adequate space to place a drain plug assembly inside the housing for transport as the exchange heads are being transported.

Each of the sending steps 302, 308 may include sending instructions for installing the sent exchange head on a commercial ware-washer without the use of tools. Sending instructions may include providing an internet location for viewing a video demonstration of installing the exchange head on the commercial ware-washer without the use of tools. Sending instructions may also include sending printed materials with the sent exchange head.

The sending step 302 may include sending the first exchange head to the ware-washer site before receiving the second exchange head. The sending step 302 may further include sending a customer a notice of an expected arrival time of the first exchange head at the first designated location. Similarly, the receiving step 304 may include receiving the second exchange head after sending the first exchange head. This step order helps minimize any ware-washer downtime by making the replacement exchange heads (either the first or second exchange head) available as soon as possible.

The sending step 302 may further include sending the first exchange head according to a maintenance schedule.

Figure 4:
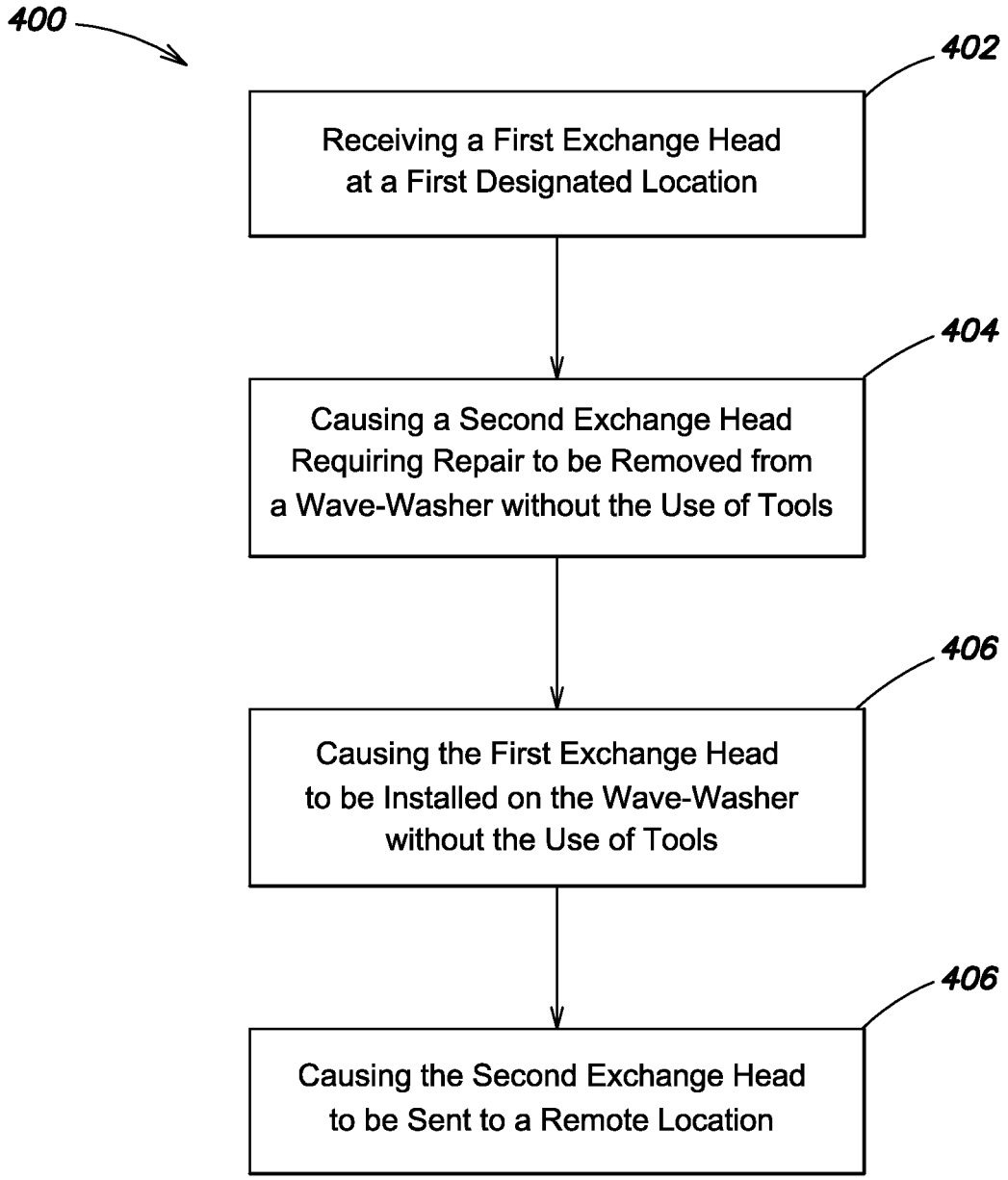
FIG. 4 is a logic flow of another example method.

FIG. 4 discloses an example method 400 described from a chemical supplier's or a ware-washer owner/user's side. The method 400 closely tracks a corollary of method 300, i.e. where method 300 describes sending, method 400 describes receiving. Method 400 is a method of replacing an exchange head of a commercial ware-washer. Step 402 includes receiving a first exchange head at a first designated location. As described above the first exchange head may be received at a site of a faulty ware-washer or at a service facility of a ware-washer maintenance provider or any location designated by the entity causing the exchange head to be replaced.

Step 404 includes causing a second exchange head requiring repair to be removed from a ware-washer without the use of tools. As described above, the second exchange head may be removed by a service technician, a sales representative, or an employee at the site of the ware-washer. Because no tools are required most individuals will be able to remove the exchange head quickly without any special training or skill. For example, a chemical supplier may cause the exchange head to be removed from a ware-washer by requesting a customer's employee to perform the task, if a service technician is unavailable.

Step 406 includes causing the first exchange head to be installed on the ware-washer without the use of tools. Step 408 includes causing the second exchange head to be sent to a remote location. The remote location may be a depot facility where multiple exchange heads in need of repair are collected before ultimately shipping them to a repair facility. The remote location may be a repair facility of the chemical supplier or a repair facility of the ware-washer manufacturer.

The receiving step 402 may further include receiving the first exchange head with a first timer setting duplicating a second timer setting of the second exchange head. That is if the second exchange head is sent directly to the ware-washer site with the second exchange head it may be convenient and more efficient to have the first exchange head's timer setting the same as the second exchange head timer settings so that the first exchange head operates without need for any adjustments. This step is most desirable if untrained persons are removing and installing the exchange heads.

Receiving step 402 may further include sending the second timer setting to a service location before receiving the first exchange head. This allows the service location to set up the first exchange head to replace the second exchange head without need for any adjustments. Sending the second timer setting may include sending a picture of the second timer of the second exchange head, as described above. Sending the second timer setting may also include sending a written explanation of the second timer setting.

The receiving step 402 may also include receiving a first drain plug assembly with the first exchange head. As described above, the first drain plug assembly may include one or more of a drain ball and associated tube, the drain lifter assembly, the link-rod, and linkage assembly. If the first drain plug assembly is received, step 406 may include causing the first drain plug assembly to be installed on the ware-washer. If step 406 includes installing the first drain plug assembly, the step 404 may include causing a second drain plug assembly to be removed from the ware-washer.

The receiving step 402 may further include receiving instructions for installing the first exchange head on the commercial ware-washer without the use of tools. Receiving instructions may include viewing instructions at an internet site for installing the first exchange head on the commercial ware-washer without the use of tools.

The causing step 408 may further include causing the second drain plug assembly to be sent to the remote location. Step 408 may further include causing the second exchange head to be sent in a package in which the first exchange head was received. Reusing the first exchange head packaging for the second exchange head is convenient and economically efficient.

Step 408 may also include causing a connection of opposing ends of at least one chemical tube together to prevent chemical leakage during transport to the service location. Connecting opposing ends of a chemical tube together prevents damaging the packaging and prevents any residual chemicals in the tube from damaging other parts of the exchange head.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A method of maintaining commercial ware-washers comprising:

sending a first exchange head to a first designated location;

receiving a second exchange head requiring repair;

repairing the second exchange head;

sending the repaired second exchange head to one of the first designated location and a second designated location; and wherein each of the first and second exchange heads each include at least one electrical connector and at least one plumbing connector and are capable of being removed from and installed on a commercial ware-washer without a use of tools.

2. The method of claim 1 further including selling or leasing at least one commercial ware-washer and the first and second exchange heads to a customer.

3. The method of claim 1 further including:

receiving a timer setting of a faulty exchange head; and duplicating the received timer setting on a first timer of the first exchange head.

4. The method of claim 3 wherein the receiving step includes receiving a picture of the timer of the faulty exchange head.

5. The method of claim 3 wherein the receiving step includes receiving a written explanation of the timer setting.

6. The method of claim 1 wherein the receiving step includes receiving a drain plug assembly with the second exchange head.

7. The method of claim 1 wherein the repairing step includes setting a second timer of the second exchange head to correspond to a timer setting of a faulty exchange head to be replaced with the second exchange head.

8. The method of claim 1 wherein the repairing step includes at least one of:

cleaning the second exchange head;

repairing faulty chemical tubes;

repairing faulty electrical components;

repairing a faulty inlet water plumbing assembly; and repairing a drain mechanism.

9. The method of claim 8 further including repairing a drain plug assembly.

10. The method of claim 1 wherein each of the sending steps includes sending instructions for installing the sent exchange head on a commercial ware-washer without the use of tools.

11. The method of claim 10 wherein sending instructions includes providing an internet location for viewing a video demonstration of installing the exchange head on the commercial ware-washer without the use of tools.

12. The method of claim 1 wherein the first designated location is a customer's warehouse.

13. The method of claim 1 wherein the first designated location is a ware-washer site.

14. The method of claim 13 further including sending the first exchange head to the ware-washer site before receiving the second exchange head.

15. The method of claim 1 further including sending a customer a notice of an expected arrival time of the first exchange head at the first designated location.

16. The method of claim 1 further including sending the first exchange head according to a maintenance schedule.

17. The method of claim 16 further including receiving the second exchange head after sending the first exchange head.

18. A method of replacing an exchange head of a commercial ware-washer comprising:

receiving a first exchange head, including at least one electrical connector and at least one plumbing connector, at a first designated location;

removing a second exchange head, including at least one electrical connector and at least one plumbing connector, requiring repair from a ware-washer without a use of tools;

installing the first exchange head on the ware-washer without the use of tools; and sending the second exchange head to a remote location.

19. The method of claim 18 wherein the receiving step includes receiving the first exchange head with a first timer setting duplicating a second timer setting of the second exchange head.

20. The method of claim 19 further including sending the second timer setting to a service location before receiving the first exchange head.

21. The method of claim 20 further including sending a picture of the second timer of the second exchange head.

22. The method of claim 20 further including sending a written explanation of the second timer setting.

23. The method of claim 18 wherein the receiving step includes receiving a first drain plug assembly with the first exchange head.

24. The method of claim 23 further including causing the first drain plug assembly to be installed on the ware-washer.

25. The method of claim 18 wherein the receiving step includes receiving instructions for installing the first exchange head on the commercial ware-washer without the use of tools.

26. The method of claim 25 wherein receiving instructions includes viewing instructions at an internet site for installing the first exchange head on the commercial ware-washer without the use of tools.

27. The method of claim 18 further causing a second drain plug assembly to be removed from the ware-washer.

28. The method of claim 27 further including causing the second drain plug assembly to be sent to the remote location.

29. The method of claim 18 further including causing the second exchange head to be sent in a package in which the first exchange head was received.

30. The method of claim 18 further including causing a connection of opposing ends of at least one chemical tube together to prevent chemical leakage during transport to the remote location.

31. The method of claim 18 further including causing a setting a first timer of the first exchange head to duplicate a setting of a second timer of the second exchange head before causing the second exchange head to be sent to the remote location.

* * * * *